US009188956B2

(12) United States Patent
Nakajima et al.

(10) Patent No.: US 9,188,956 B2
(45) Date of Patent: Nov. 17, 2015

(54) BALANCE, TIMEPIECE MOVEMENT, TIMEPIECE AND MANUFACTURING METHOD OF BALANCE

(71) Applicant: SEIKO INSTRUMENTS INC., Chiba (JP)

(72) Inventors: Masahiro Nakajima, Chiba (JP); Takashi Niwa, Chiba (JP); Takuma Kawauchiya, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 4 days.

(21) Appl. No.: 14/097,300

(22) Filed: Dec. 5, 2013

(65) Prior Publication Data

US 2014/0185418 A1 Jul. 3, 2014

(30) Foreign Application Priority Data

| | | |
|---|---|---|
| Dec. 28, 2012 | (JP) | 2012-288675 |
| Dec. 28, 2012 | (JP) | 2012-288676 |
| Aug. 29, 2013 | (JP) | 2013-178499 |
| Aug. 29, 2013 | (JP) | 2013-178500 |

(51) Int. Cl.

| | |
|---|---|
| ***G04B 17/06*** | (2006.01) |
| ***G04B 15/06*** | (2006.01) |
| ***G04B 17/22*** | (2006.01) |

(52) U.S. Cl.

CPC ..... *G04B 15/06* (2013.01); *G04B 17/06* (2013.01); *G04B 17/22* (2013.01)

(58) Field of Classification Search

CPC .... G04B 17/06; G04B 17/063; G04B 17/066; G04B 17/22; G04B 15/06

USPC ..... 29/896.3–896.34; 368/127–131, 368/169–178

See application file for complete search history.

(56) References Cited

U.S. PATENT DOCUMENTS

| | | | | |
|---|---|---|---|---|
| 1,333,161 | A * | 3/1920 | Coats et al. | 368/127 |
| 1,982,726 | A * | 12/1934 | Ditisheim | 74/15.66 |
| 2,936,572 | A * | 5/1960 | Biemiller et al. | 368/171 |
| 4,993,007 | A * | 2/1991 | Meister | 368/294 |

* cited by examiner

*Primary Examiner* — Sean Kayes

(74) *Attorney, Agent, or Firm* — Adams & Wilks

(57) ABSTRACT

A balance includes a balance staff pivotally supported rotatably and a balance wheel arranged around the balance staff. The balance wheel has one end portion fixed to a connection arm radially connected to the balance staff and a free end portion configured to be radially deformed. The balance wheel has a first rim connected to the connection arm and a second rim in overlapping relation with the first rim and formed of a material having a linear expansion coefficient different from the first rim. The first and second rims are arranged in a circumferential direction and are bonded together by melting portions formed of melted materials of the first and second rims. The melting portions are formed on upper and lower surfaces of and in an intermediate position between the first and second rims.

18 Claims, 6 Drawing Sheets

BALANCE, TIMEPIECE MOVEMENT, TIMEPIECE AND MANUFACTURING METHOD OF BALANCE

BACKGROUND OF THE INVENTION

1. Field of the Invention

The present invention relates to a balance, a timepiece movement having the balance, a timepiece and a manufacturing method of the balance.

2. Background Art

A speed regulator for a mechanical timepiece is generally configured to have a balance and a hair spring. Such a balance includes a balance staff and a balance wheel fixed to the balance staff. The balance is a member which oscillates by cyclically rotating forward and backward around an axle of the balance staff. In this case, it is important that an oscillation cycle of the balance is set to be within a predetermined control value. This is because a rate of the mechanical timepiece (degree indicating whether the timepiece is fast or slow) varies if the oscillation cycle is beyond the control value. However, the oscillation cycle is likely to vary due to various causes, and for example, also varies due to a temperature change.

Here, an oscillation cycle T described above is expressed by Equation 1 as follows.

$$T = 2\pi\sqrt{\frac{I}{K}} \qquad \text{Equation 1}$$

In Equation 1, the "moment of inertia of the balance" is indicated by I and a "spring constant of the hair spring" is indicated by K. Therefore, if the moment of inertia of the balance or the spring constant of the hair spring varies, the oscillation cycle also varies.

Here, a metal material used in the balance includes a material whose linear expansion coefficient is generally positive and which is expanded due to a temperature rise. Therefore, the balance wheel is radially enlarged to increase the moment of inertia. In addition, since the Young's modulus of a steel material which is generally used in the hair spring has a negative temperature coefficient, the temperature rise causes the spring constant to be lowered.

As described above, in a case of the temperature rise, the moment of inertia is increased accordingly and a spring coefficient of the hair spring is lowered. Therefore, as is apparent from Equation 1 expressed above, the oscillation cycle of the balance has characteristics of being shorter at a low temperature and being longer at a high temperature. For that reason, as temperature characteristics of the timepiece, the timepiece is fast at the low temperature and slow at the high temperature.

Therefore, as a measure to improve the temperature characteristics of the oscillation cycle of the balance, the following two methods have been known.

The first method is a method where the temperature coefficient of the Young's modulus near an operating temperature range of the timepiece (for example, 23° C.±15° C.) is caused to have positive characteristics by employing a constant elastic material such as so-called Coelinvar as the material of the hair spring. In this manner, in the operating temperature range, it is possible to cancel the change in the moment of inertia of the balance with respect to the temperature, thereby enabling temperature dependence of the oscillation cycle of the balance to be lessened.

As the second method, there has been a known method of using a bimetal where metal plates formed of materials having different thermal expansion coefficients are radially bonded together in a portion of multiple rim portions configuring the balance wheel, while one end portion in a circumferential direction is set to be a fixed end and the other end in the circumferential direction is set to be a free end (refer to "The Theory of Horology" published by Swiss Federation of Technical Colleges, English Version, Second Edition, April 2003, pages 136 to 137).

Out of the bimetals, for example, the material of the metal plate positioned radially inward employs a low thermal expansion material such as Invar and the material of the plate positioned radially outward employs a high thermal expansion material such as brass. In this manner, in the case of the temperature rise, the bimetals are deformed inward so as to move the free end side radially inward due to a difference in the thermal expansion coefficients. This enables an average diameter of a rim portion to be radially reduced and enables the moment of inertia to be lowered. Thus, it is possible to cause the temperature characteristics of the moment of inertia to have a negative slope. As a result, it is possible to lessen the temperature dependence of the oscillation cycle of the balance.

However, in the above-described first method, there is a possibility that when manufacturing the hair spring using the constant elastic material such as the Coelinvar, the temperature coefficient of the Young's modulus may vary greatly depending on composition during a melting process and various processing conditions during a heat treatment process. Therefore, a strict manufacturing control process is required, thereby not facilitating the production of the hair spring. Accordingly, in some cases, it is difficult to cause the temperature coefficient of the Young's modulus to be positive near the operating temperature range of the timepiece.

In addition, in the above-described second method, as a general method for configuring the balance wheel, after brazing an annular metal member formed of the high expansion material around an outer periphery of a metal member which is positioned radially inward and formed of the low expansion material by using a brazing filler metal, the balance wheel is formed through a cutting process by turning. Accordingly, an amount of the brazing filler metal is not constant depending on a size of a clearance between parts, and there are large variations in the moment of inertia when the balance wheel is formed. In addition, radial deviation between the parts is likely to occur and a ratio of a plate thickness of a low thermal expansion portion and a plate thickness of a high thermal expansion portion is not constant in multiple rim portions when the balance wheel is formed. Thus, there is a problem in that a deformation volume of the free end has large variations due to the temperature change. In addition, as another method for configuring the balance wheel, an annular high expansion material having a lower melting point than a low expansion material is arranged outside the low expansion material finished to have a predetermined outer diameter, the high expansion material is bonded to the low expansion material by heating these materials at a temperature for melting the high expansion material only, and then the balance wheel is formed through the cutting process by turning. In this method, since the brazing filler metal is not interposed between the low expansion material and the high expansion material, there is no possibility that the moment of inertia may have large variations. However, when forming the balance wheel, inner and outer diameter processing for the low expansion material and outer diameter processing for the high expansion material are processes separate from each other.

Thus, it is difficult to keep a constant ratio of plate pressures of respective materials, thereby causing a problem in that the deformation volume of the free end has the large variations due to the temperature change. Furthermore, in both of the manufacturing methods, it is necessary to heat the brazing filler metal or the high expansion material at a high temperature of 800° C. or higher for example, thereby leaving a large residual stress because of a difference in the linear expansion coefficient of the materials during a cooling process. In addition, since it is necessary to perform processing after bonding, a processing stress is left on the balance wheel. Therefore, the deformation is likely to occur when forming the free end at a portion of the rim, and the deformation due to a time-dependent change is likely to occur, thereby causing a problem in that a balance of the moment of inertia tends to deteriorate. As described above, there is a problem in that a target value of the moment of inertia which has been set when designing is largely deviated, and further, a rotation balance deteriorates due to the temperature change. Therefore, it is necessary to adjust the moment of inertia for the overall balance or to adjust the deformation volume for the respective rims with respect to the temperature. In practice, it is necessary to carry out work for attaching a plurality of balance screws to the rim portion and adjusting an attachment position of the balance screws or screwing intensity. For example, even if the temperature rises, if the timepiece is slow, a process of correcting the moment of inertia is performed by carrying out the work such as changing work to transfer the balance screws to the free end side.

As described above, since fine adjustment work using the balance screws is required in practice, the temperature correction needs labor and time, thereby resulting in poor workability.

SUMMARY OF THE INVENTION

The present invention is made in view of such circumstances, and an object thereof is to provide a balance which does not need to readjust a rate, does not reduce a rotational balance and rotational performance, and which can easily and precisely perform temperature correction; and a timepiece movement including the same; a timepiece; and a manufacturing method of the balance.

The present invention provides the following means to solve the above problems.

(1) A balance according to the present invention includes a balance staff which is pivotally supported rotatably; and a balance wheel which is arranged around the balance staff and in which one end portion is a fixed end portion fixed to a connection arm which is radially connected to the balance staff and the other end portion is a free end portion which can be radially deformed. The balance wheel has a first rim which is connected to the connection arm and a second rim which is arranged to be overlapped with the first rim and formed of a material having a linear expansion coefficient different from that of the first rim, and the first rim and the second rim are bonded together by using a melting portion in which respective materials thereof are melted.

According to the balance of the present invention, if a temperature is changed, there is a difference in thermal expansion coefficients between the first rim and the second rim. The first rim and the second rim are mutually restrained from moving relative to each other by using the melting portion, thereby enabling the free end portion of the balance wheel to move radially inward or outward. Accordingly, it is possible to change a distance from the free end portion of the balance wheel to an axle, and thus it is possible to change the moment of inertia of the balance itself. Therefore, it is possible to change a slope of temperature characteristics in the moment of inertia, and it is possible to lessen temperature dependence of an oscillation cycle of the balance. Consequently, it is possible to provide a high quality balance in which a rate influenced by a temperature change is unlikely to vary. Furthermore, the first rim and the second rim are bonded together by using the melting portion in which the respective materials thereof are melted. Therefore, it is possible to configure the balance wheel without changing the moment of inertia which is calculated based on shape dimensions and specific gravities of the materials in the first rim and the second rim. Thus, it is no longer required to reduce deviation in the moment of inertia and to readjust the rate.

(2) In the balance according to the present invention, the melting portion may be bonded so that the first rim and the second rim are melted by laser welding.

In this case, the balance is less deformed due to the heat during the bonding and less affected by residual stress, thereby allowing the high quality balance which has no change in the moment of inertia due to the bonding or no time-dependent change.

(3) In the balance according to the present invention, the melting portion may be continuously formed in a circumferential direction on a bonding surface between the first rim and the second rim.

In this case, an interval between the first rim and the second rim and the relative movement thereof can be restrained at the maximum, and thus it is possible to maximize the deformation volume of the free end portion due to the temperature.

(4) In the balance according to the present invention, the melting portion may be formed in an end portion of a bonding surface by the laser welding from a direction parallel to the bonding surface between the first rim and the second rim.

In this case, a boundary between the first rim and the second rim which are bonded is easily and visually checked and there is no poor bonding quality resulting from deviation in an irradiation position of the laser. Therefore, it is possible to perform highly reliable temperature correction of the moment of inertia.

(5) In the balance according to the present invention, the melting portion may be formed on a bonding surface by the laser welding from a direction substantially perpendicular to the bonding surface between the first rim and the second rim.

In this case, it is possible to form the balance wheel in minimal bonding places, thereby easily allowing the high quality balance.

(6) A timepiece movement according to the present invention includes a barrel wheel which has a power source; a train wheel which transmits a rotational force of the barrel wheel; and an escapement mechanism which controls rotation of the train wheel. The escapement mechanism includes the balance according to the present invention.

According to the timepiece movement of the present invention, as described above, there is provided the balance in which the temperature dependence of the oscillation cycle is lessened and the rate influenced by the temperature change is unlikely to vary. Therefore, it is possible to provide the high quality timepiece movement having few errors.

(7) A timepiece according to the present invention includes the timepiece movement according to the present invention.

According to the timepiece of the present invention, there is provided the timepiece movement in which the rate influenced by the temperature change is unlikely to vary. Therefore, it is possible to provide the high quality timepiece having few errors.

(8) A manufacturing method of the balance according to the present invention includes a step of processing an individual rim shape in which shapes of an inner diameter side and an outer diameter side of the first rim and shapes of an inner diameter side and an outer diameter side of the second rim are processed; and a bonding step of forming a melting portion in which one outer diameter side and the other inner diameter side in the first rim and the second rim are brought into contact with each other so as to form a bonding surface and materials of the first rim and the second rim are melted together on the bonding surface.

According to the manufacturing method of the balance according to the present invention, it is possible to suppress unintentional deformation of the free end after both rims are bonded together. In addition, it is possible to effectively reduce the residual stress occurring during the cooling process after both rims are bonded together.

According to the present invention, in the balance where the temperature correction is performed by using the linear expansion coefficient, it is possible to easily and precisely carryout temperature correction work without readjusting the rate and without degrading the rotational balance and the rotational performance.

DETAILED DESCRIPTION OF THE INVENTION

Hereinafter, an embodiment of the present invention will be described with reference to the drawings.

Figure 1:
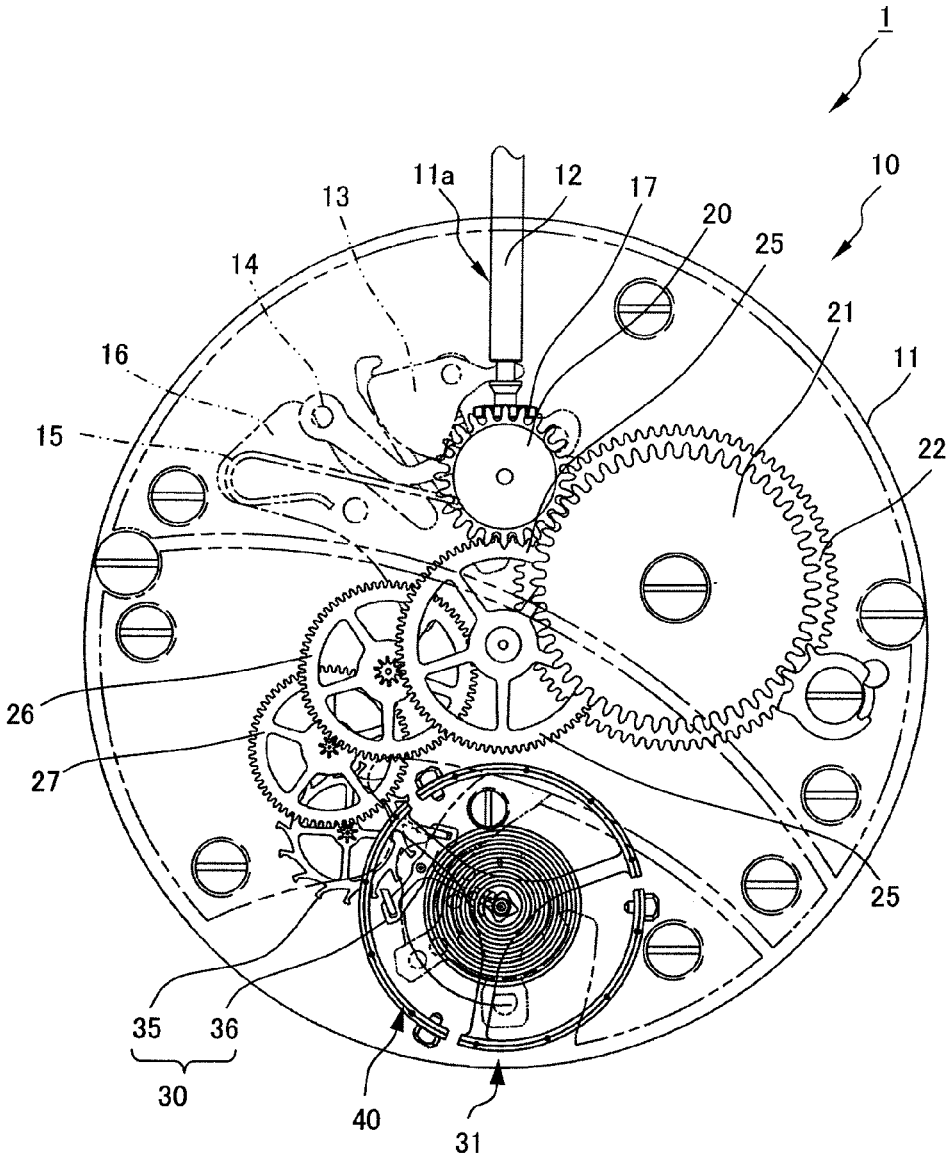
FIG. 1 illustrates a first embodiment and is a configuration diagram of a movement of a mechanical timepiece.

As illustrated in FIG. 1, a mechanical timepiece 1 according to the present embodiment is a watch for example, and is configured to include a movement (timepiece movement) 10 and a casing (not illustrated) which accommodates the movement 10.

Configuration of Movement

The movement 10 has a main plate 11 configuring a substrate. A dial (not illustrated) is arranged on a rear side of the main plate 11. A train wheel incorporated in a front side of the movement 10 is referred to as a front train wheel and a train wheel incorporated in a rear side of the movement 10 is referred to as a rear train wheel.

A winding stem guide hole 11*a* is formed in the main plate 11 and a winding stem 12 is rotatably incorporated therein. The winding stem 12 has an axially determined position by a switching device having a setting lever 13, a yoke 14, a yoke spring 15 and a setting lever jumper 16. In addition, a winding pinion 17 is rotatably disposed in a guide axle of the winding stem 12.

In such a configuration, if the winding stem 12 is rotated in a state where the winding stem 12 is located in a first winding stem position (zero stage) closest to an inner side of the movement 10 along an axle direction, the winding pinion 17 is rotated via the rotation of a clutch wheel (not illustrated). Then, if the winding pinion 17 is rotated, a crown wheel 20 meshing therewith is rotated. Then, if the crown wheel 20 is rotated, a ratchet wheel 21 meshing therewith is rotated. Further, if the ratchet wheel 21 is rotated, a main spring (power source; not illustrated) accommodated in a barrel wheel 22 is wound up.

The front train wheel of the movement 10 is configured to include not only the barrel wheel 22 but also a center wheel and pinion 25, a third wheel and pinion 26 and a second wheel and pinion 27, and fulfills a function of transmitting the rotational force of the barrel wheel 22. In addition, an escapement mechanism 30 and a speed control mechanism 31, each of which controls rotation of the front train wheel, is arranged in the front side of the movement 10.

The center wheel and pinion 25 meshes with the barrel wheel 22. The third wheel and pinion 26 meshes with the center wheel and pinion 25. The second wheel and pinion 27 meshes with the third wheel and pinion 26.

The escapement mechanism 30 controls the rotation of the above-described front train wheel and includes an escape wheel 35 meshing with the second wheel and pinion 27 and a pallet fork 36 which causes the escape wheel 35 to escape so as to be regularly rotated.

Figure 2:
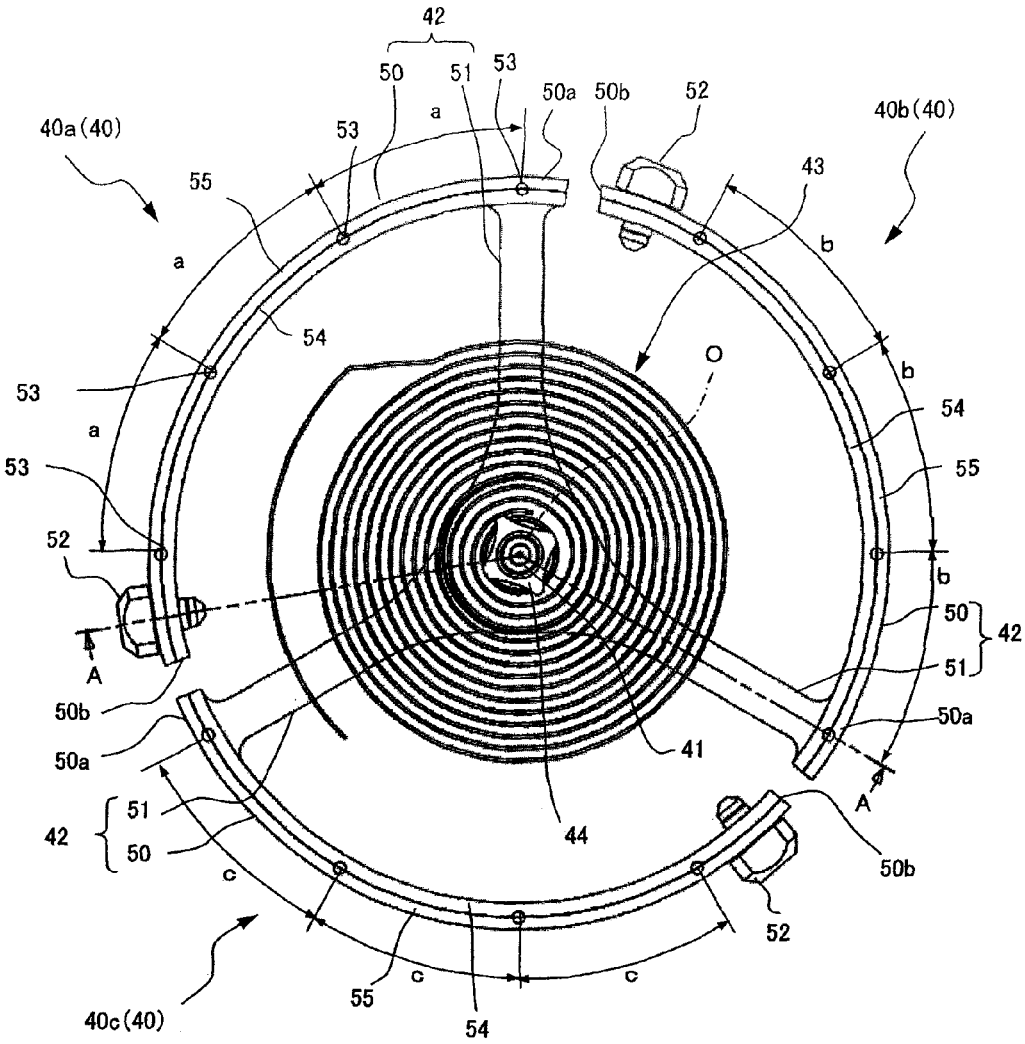
FIG. 2 is a top view of a balance configuring the movement illustrated in FIG. 1.
Figure 3:
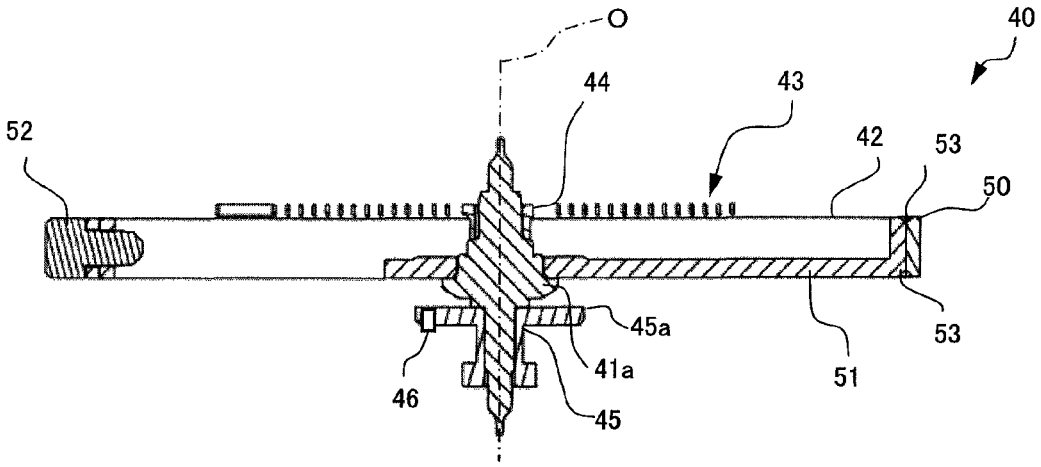
FIG. 3 is a cross-sectional view taken along the line A-A illustrated in FIG. 2.

The speed control mechanism 31 controls a speed of the escapement mechanism 30 and as illustrated in FIGS. 1 to 3, includes a balance 40.

Configuration of Balance

The balance 40 configuring the speed control mechanism 31 includes a balance staff 41 which is pivotally supported rotatably around an axle O and a balance wheel 42 fixed to the balance staff 41. The balance 40 is rotated forward and backward around the axle O at a constant oscillation cycle by using potential energy stored in a hair spring 43 by the power transmitted from the escapement mechanism 30.

In the present embodiment, a direction orthogonal to the axle O is referred to as a radial direction and a direction revolving around the axle O is referred to as a circumferential direction.

The balance staff 41 is an axle body which vertically extends along the axle O, and an upper portion and a lower portion are pivotally supported by a member such as a main plate or a balance bridge (all not illustrated). A substantially intermediate portion of the balance staff 41 in the vertical direction is a large diameter portion 41*a* having the largest diameter. Then, the balance wheel 42 is fixed to the balance staff 41 via the large diameter portion 41*a*.

A cylindrical double roller 45 is mounted externally and coaxially with the axle O on a portion positioned below the large diameter portion 41*a* in the balance staff 41. The double roller 45 has an annular rim portion 45*a* protruding radially outward, and an impulse pin 46 for oscillating the pallet fork 36 is fixed to the rim portion 45*a*.

For example, the hair spring 43 is a flat hair spring which is wound in a spiral shape inside one plane, and an inner end portion thereof is fixed to a portion positioned above the large diameter portion 41*a* in the balance staff 41 via a collet 44. Then, the hair spring 43 plays a role of storing the power transmitted to the escape wheel 35 from the second wheel and pinion 27 and vibrating the balance wheel 42.

As illustrated in FIGS. 2 and 3, the balance wheel 42 includes a substantially annular rim 50 which surrounds the balance staff 41 from outside in the radial direction and a connection arm 51 which connects the rim 50 and the balance staff 41 in the radial direction.

The rim 50 is a belt-shaped piece which extends in an arc shape (one third of a circle) along the circumferential direction, and is equally arranged in rotational symmetry around the axle O. In addition, the rim 50 is formed from a first rim 54 which is arranged radially inward and a second rim 55 which is arranged radially outward along the first rim 54.

A connection arm 51 is arranged at an interval of 120° around the axle O. Then, in the connection arm 51, a base end side thereof is connected to the large diameter portion 41*a* of the balance staff 41 and a tip side thereof extends radially outward to the rim 50.

Then, in a fixed end portion 50*a* of the rim 50, the first rim 54 and tip end side of the connection arm 51 are connected to each other. In this manner, the rim 50 is supported by the balance staff 41 via the connection arm 51.

Another end side of the rim 50 in the circumferential direction is a free end portion 50*b* which is deformable in the radial direction, and a weight 52 is attached to a tip side of the free end portion 50*b*.

The weight 52 is attached in order to increase a change amount of the moment of inertia caused by the temperature change. The weight 52 may be omitted if the temperature correction is enabled by merely the change amount of the moment of inertia caused by the deformation of the free end portion 50*b*.

The first rim 54 and the second rim 55 of the rim 50 are restrained from moving relative to each other near a melting portion 53 by a plurality of melting portions 53 spaced apart from each other by a predetermined separation interval.

The melting portions 53 are formed in a direction parallel to a boundary surface between the first rim 54 and the second rim 55, that is, on upper and lower surfaces of the rim 50 by laser welding for example, and restrain the first rim 54 and the second rim 55 from being separated from each other and slidingly moved.

As a method of forming the melting portions 53, in addition to the laser welding, there is a fusion welding method without adding a filler material, such as resistance welding and electron beam welding.

The first rim 54 is configured to have a material having a linear expansion coefficient different from the second rim 55.

Figure 4:
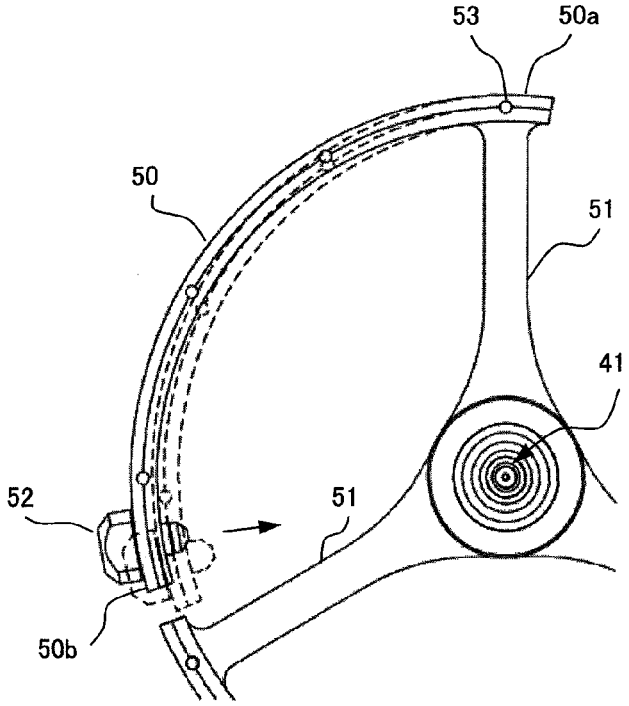
FIG. 4 illustrates a state where the balance illustrated in FIG. 2 is deformed.

In the description of the present embodiment, the first rim 54 is formed of a low thermal expansion material such as Invar and the second rim 55 is formed of a high thermal expansion material such as stainless steel, which has a thermal expansion coefficient higher than that of the first rim 54. Therefore, if the ambient temperature rises, as illustrated in FIG. 4, the second rim 55 is more greatly expanded in the circumferential direction than the first rim 54. This moves the free end portion 50*b* of the rim 50 radially inward. Accordingly, the weight 52 attached to the tip of the free end portion 50*b* also moves radially inward (refer to the dotted line in FIG. 4).

In the description, the hair spring 43 of the present embodiment is formed of a common steel material having a negative temperature coefficient in which the Young's modulus is decreased as the temperature rises.

In addition, as the material of the first rim 54 and the second rim 55, the material is not limited the above-described material, but various materials may be properly and selectively used. In this case, it is preferable to select both materials so as to have a large difference in the thermal expansion coefficient so far as is possible.

Next, a forming procedure of the balance wheel in the present embodiment will be described.

First, the annular first rim 54 including the connection arm 51 formed of the low expansion material and the annular second rim 55 formed of the high expansion material are prepared. Here, the outer diameter and the inner diameter of the first rim 54 and the second rim 55, respectively, are processed in the same process as each other (step of processing an individual rim shape). Then, after the first rim 54 and the second rim 55 are combined with each other, the melting portion 53 is formed at a boundary portion and the first rim 54 and the second rim 55 are bonded together (bonding step). Further, one edge of the rim 50 is cut off to form the free end portion 50*b*.

After processing the first rim 54 and the second rim 55, it is preferable to perform heat treatment for removing the residual stress which is suitable to each material, if necessary.

In this manner, after processing of the outer shapes is completed for the inner diameter side and the outer diameter side of the first rim 54 and the second rim 55, respectively, the first rim 54 and the second rim 55 are bonded together by using the melting portion 53. Accordingly, it is possible to ensure a degree of freedom which can adjust each internal residual stress of the first rim 54 and the second rim 55 before bonding (for example, by using the above-described heat treatment). Thus, it is possible to suppress the free end from being unintentionally deformed after the bonding of both rims. In addition, since the bonding of both rims is performed only by localized heating to form the melting portion 53, it is possible to effectively reduce the residual stress occurring during a cooling process. Therefore, the deformation of the free end after the bimetallic balance is formed and the time-dependent deformation are suppressed, thereby enabling the balance of the balance wheel to be stably ensured.

Since the first rim 54 and the second rim 55 of the rim 50 have a plurality of restraint portions (melting portions) 53 spaced with a constant interval a, each relative movement is restrained near the restraint portions (melting portions) 53. In FIG. 2, in the belt-shaped pieces into which the rim 50 is divided along the circumferential direction, intervals of the plurality of restraint portions (melting portions) 53 in each of the belt shaped pieces (first arcuate section 40*a*, second arcuate section 40*b* and third arcuate section 40*c*) are described as the interval a, an interval b and an interval c. In the following description, a case will be described where the plurality of restraint portions (melting portions) 53 are disposed by being spaced with the interval a in all the belt-shaped pieces (that is, the interval a, the interval b and the interval c are all the same).

The restraint portions (melting portions) 53 are formed by resistance spot welding or laser welding for example, and restrain the first rim 54 and the second rim 55 from being separated from each other and slidingly moving relative to each other.

The first rim 54 is configured to have the material having a linear expansion coefficient different from the second rim 55.

In addition, in the present embodiment, the restraint portions (melting portions) 53 are formed on the upper surface and the lower surface of the rim 50, but without being limited thereto, may be formed in an intermediate position between the upper surface and the lower surface of the rim 50. In this case, it is possible to form the restraint portions (melting portions) 53 by irradiating laser beams on an outer peripheral side surface of the rim 50 for example and by overlapping and welding the first rim 54 with the second rim 55.

Temperature Correction Method of Moment of Inertia

Next, a temperature correction method of the moment of inertia using the balance 40 will be described.

According to the balance 40 of the present embodiment, if the temperature change occurs, it is possible to cause the free end portion 50*b* to move in the radial direction since the second rim 55 is more largely expanded and contracted than the first rim 54. That is, as illustrated in FIG. 4, when the temperature rises, the expansion of the second rim 55 causes the free end portion 50*b* to move radially inward. On the other hand, when the temperature falls, the free end portion 50*b* can be caused to move radially outward.

Therefore, it is possible to change the moment of inertia of the balance 40 itself in such a manner that a position of the weight 52 attached to the tip of the free end portion 50*b* is moved radially inward or outward, and a distance from the axle O to the weight 52 is changed. That is, when the temperature rises, the moment of inertia is decreased by moving the position of the weight 52 radially inward, and when the temperature falls, the moment of inertia is increased by moving the position of the weight 52 radially outward. In this manner, it is possible to change a slope of temperature characteristics of the moment of inertia to a negative slope. Therefore, it is possible to perform the temperature correction of the moment of inertia.

Incidentally, according to the balance 40 of the present embodiment, the first rim 54 and the second rim 55 are configured to have a dimension and a shape which are calculated so as to match a predetermined moment of inertia by matching the spring constant of the hair spring 43 before bonding. Since the melting portion 53 is bonded by melting the materials themselves of the first rim 54 and the second rim 55, there is no increase or decrease in weight which is caused by the bonding, unlike in a case of bonding using a brazing filler metal in the related art. That is, even if the first rim 54 and the second rim 55 are bonded together using the melting portion 53, the moment of inertia of the balance wheel 42 is not changed and it is possible to obtain the predetermined moment of inertia which has been calculated in advance. Furthermore, unlike in the method in the related art, there is no need to perform a machining process after the bonding. Accordingly, a ratio of the plate thickness of the first rim 54 to the plate thickness of the second rim 55 is not changed, and thus there is no variation in the deformation volume with respect to the temperature change in a plurality of rims 50. Therefore, since the plurality of the rims 50 are equally deformed due to the temperature change, the rotational balance is not degraded. In addition, before bonding the first rim 54 and the second rim 55 together, it is possible to properly perform the heat treatment to remove the residual stress. Since the localized heating is performed during the bonding, there is no deformation in forming the free end portion 50*b*. Since the time-dependent change does not occur while the free end portion 50*b* is in use, there is no possibility of the balance of the moment of inertia being degraded.

In addition, according to the balance 40 of the present embodiment, in the melting portion 53, the first rim 54 and the second rim 55 are melted and bonded together by the laser welding. Since the laser welding enables the localized heating and welding, the deformation due to the heat of the surround portion or the residual stress due to the bonding is minimized. Therefore, there is no disadvantage that accuracy of the oscillation cycle is degraded due to the change in the moment of inertia caused by the deformation during the bonding or due to the changed shape influenced by the residual stress with the lapse of time.

Bonding Method Using Laser Welding

Next, a bonding method between the first rim 54 and the second rim 55 by using laser welding when forming the above-described balance 40 will be described.

As illustrated in FIGS. 2 and 3, in the rim 50, the first rim 54 is arranged radially inward, the second rim 55 is arranged radially outward, and a boundary thereof is exposed to the upper surface and the lower surface in a direction of the axle. Here, a portion of the first rim 54 and the second rim 55 is heated and melted to form and bond the melting portion 53 by irradiating laser beams to the boundary from the upper surface and the lower surface in the direction of the axle. The balance wheel 42 is configured by forming the melting portions 53 with a predetermined separated interval. Here, an irradiation position of the laser beam can be positioned while being observed by a camera and thus it is possible to accurately irradiate the laser beam to the boundary between the first rim 54 and the second rim 55. Therefore, the first rim 54 and the second rim 55 can be reliably bonded together, thereby providing a very reliable balance.

Figure 5:
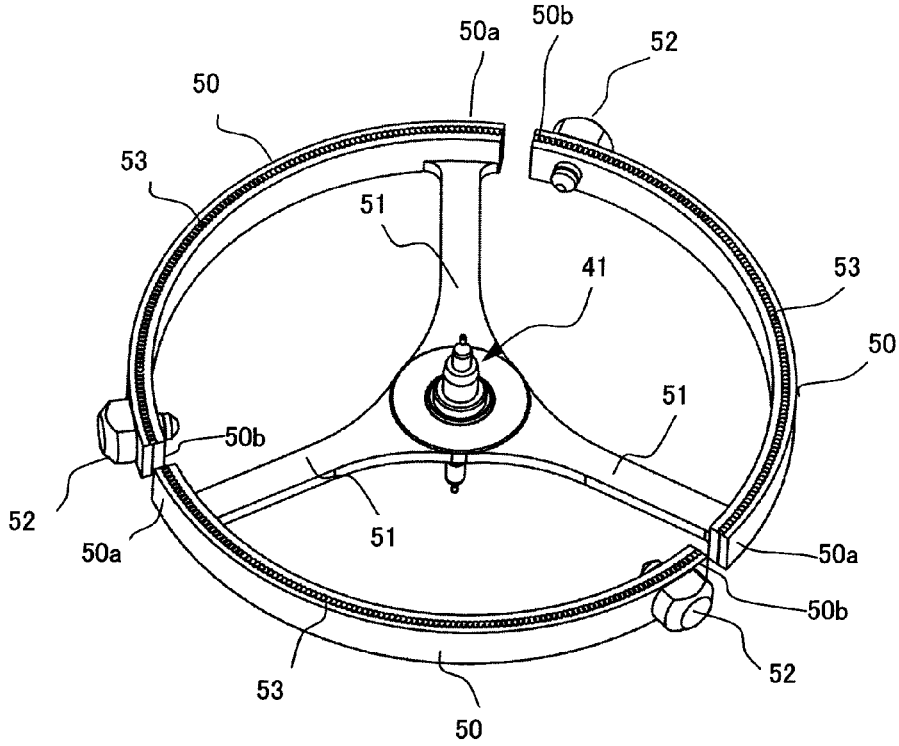
FIG. 5 illustrates another bonding example of the balance illustrated in FIG. 2.

In addition, as illustrated in FIG. 5, the melting portions 53 may be continuously formed in the circumferential direction without the separated interval. If the irradiation position is moved so as to be overlapped with the melting portions 53 by irradiating the laser beam intermittently or continuously, the melting portions 53 can be formed by using so-called seam welding. In this case, it is possible to restrain the interval or the relative movement between the first rim 54 and the second rim 55 at the maximum, and thus it is possible to maximize the deformation volume of the free end portion 50*b* which is caused by the temperature.

Figure 6:
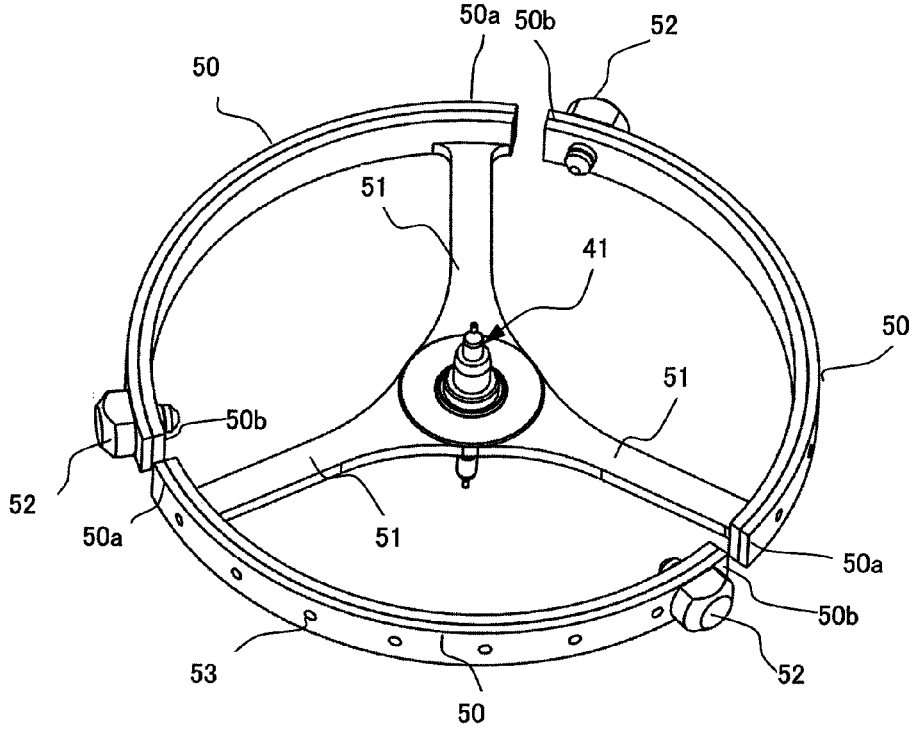
FIG. 6 illustrates still another bonding example of the balance illustrated in FIG. 2.

In addition, as illustrated in FIG. 6, the melting portions 53 may be formed on a bonding surface by using the laser welding from a direction substantially perpendicular to the bonding surface between the first rim and the second rim. Here, the melting portions 53 are formed to be bonded together on the bonding surface by using superposition welding, in which the laser beam is irradiated from a side surface of the balance wheel 42 in the circumferential direction so as to melt the first rim 54 through the second rim 55. In this case, since the first rim 54 and the second rim 55 can be restrained by using the minimum number of melting portions 53, it is possible to easily obtain a balance having high precision. The bonding forms illustrated in FIGS. 4 to 6 can be diversely combined.

In the description of the present embodiment, the hair spring 43 is formed of the common steel material having the negative temperature coefficient in which Young's modulus is decreased as the temperature rises, the first rim 54 is formed of the low thermal expansion material, and the second rim 55 is formed of the high thermal expansion material, which has a thermal expansion coefficient higher than that of the first rim 54. However, the first rim 54 may be formed of the high thermal expansion material by using a constant elastic material such as Coelinvar for the hair spring 43, and the second rim 55 may be formed of the material having a lower thermal expansion coefficient than that of the first rim 54. In this case, the free end portion 50*b* of the rim 50 can be deformed radially inward when the temperature rises, and can be deformed radially outward when the temperature falls. Therefore, it is possible to perform the temperature correction of the moment of inertia so as to match the hair spring 43 in which the temperature coefficient of Young's modulus is positive.

As described above, according to the balance 40 of the present embodiment, it is possible to precisely perform the temperature correction which does not need to change the moment of inertia when forming the balance wheel 42 and does not degrade the rotational balance due to the temperature change. Accordingly, unlike in a case of using a balance screw in the related art, it is not necessary to readjust the rate of the rotational balance.

Figure 7:
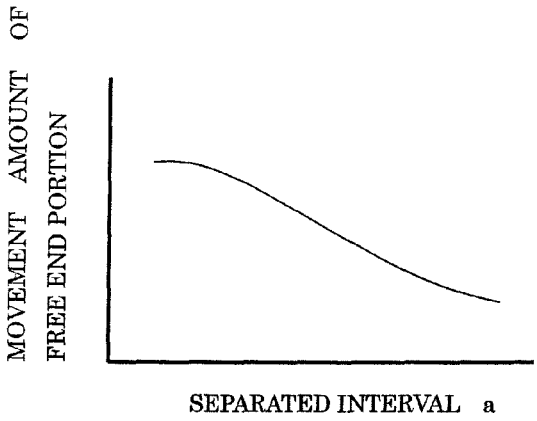
FIG. 7 illustrates a relationship between a separated interval of restraint portions (melting portions) and a deformation volume of the balance illustrated in FIG. 2.

Incidentally, according to the balance 40 of the present embodiment, the restraint portions (melting portions) 53 are arranged with the predetermined separated interval a, and as illustrated in FIG. 7, a movement amount of the free end portion 50*b* of the rim 50 due to the temperature change is changed depending on a size of the separated interval a. That is, if the separated interval a is increased, the movement amount of the free end portion 50*b* is decreased, and if the separated interval a is decreased, the movement amount of the free end portion 50*b* is increased. That is, it is possible to change the slope of the temperature characteristics of the moment of inertia depending on the size of the separated interval a. Therefore, it is possible to easily set the temperature correction amount of the moment of inertia by determining the separated interval a so as to have the slope of the temperature characteristics of the necessary moment of inertia in advance.

In addition, according to the balance 40 of the present embodiment, the separated interval a of the restraint portions (melting portions) 53 of the rim 50 is set so as to match a rate of change in the spring constant due to the temperature of the hair spring 43 to be combined therewith. That is, if the rate of change due to the temperature of the spring constant of the hair spring 43 and a relationship between the separated interval a of the restraint portions (melting portions) 53 of the rim 50 and the movement amount of the free end portion 50*b* of the rim 50 are understood in advance, it is possible to set the slope of the temperature characteristics of the moment of inertia to match the hair spring 43 to be combined therewith. Therefore, it is possible to perform the more accurate temperature correction.

Adjustment Method of Temperature Correction Amount of Moment of Inertia

Next, an adjustment method of the temperature correction amount of the moment of inertia which uses the above-described balance 40 will be described.

The hair spring 43 has variations in the temperature characteristics of the spring constant due to variations in the shape and the dimension or variations in the temperature characteristics of Young's modulus. Therefore, when attempting to perform the temperature correction with higher precision, it is necessary to minutely adjust the slope of the temperature characteristics of the moment of inertia for the balance 40 by matching the variations in the temperature characteristics of the spring constant for the hair spring 43.

As described above, according to the balance 40 of the present embodiment, it is possible to change the movement amount of the free end portion 50*b* of the rim 50 which is caused by the temperature change depending on the size of the separated interval a of the restraint portions (melting portions) 53 of the rim 50. Therefore, it is possible to more minutely adjust the correction amount of the moment of inertia of the balance 40 by adjusting the separated interval a after combining the hair spring 43 with the balance 40.

Figure 9:
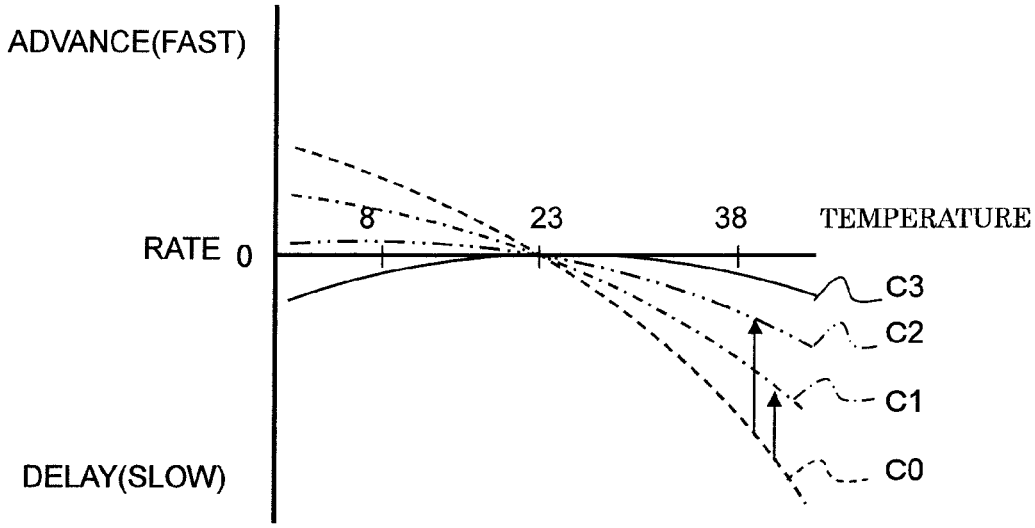
FIG. 9 illustrates temperature characteristics of a rate in the balance illustrated in FIGS. 8A and 8B.

Specifically, as illustrated in FIG. 9, the separated interval a of the restraint portions (melting portions) 53 is caused to have a predetermined interval in advance so that the temperature correction amount of the moment of inertia of the balance 40 is slightly smaller than a necessary correction amount. After combining the hair spring 43 with the balance 40, the rate with respect to the temperature is measured. Since the temperature correction amount of the moment of inertia is set to be small as described above, the rate with respect to the temperature is slightly fast at the low temperature and is slightly slow at the high temperature (refer to C0 in FIG. 9).

Figure 8A:
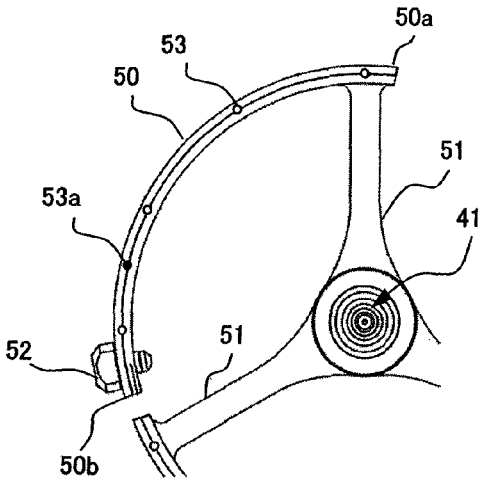
FIGS. 8A and 8B illustrate an adjustment method of a correction amount in a moment of inertia of the balance illustrated in FIG. 2.
Figure 8B:
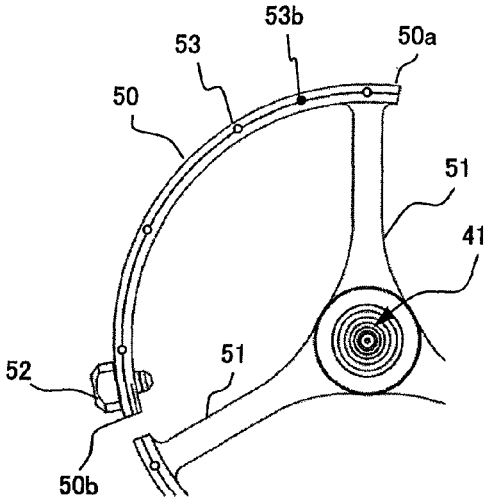

Here, as illustrated in FIG. 8A, if an additional restraint portion (melting portion) 53*a* is added to the intermediate position of the adjacent restraint portion (melting portion) 53 close to a free end portion 50*b* of the rim 50, the slope of the temperature characteristics of the rate becomes smaller (refer to C1 in FIG. 7). As illustrated in FIG. 8B, if an additional restraint portion (melting portion) 53*b* is added to the intermediate position of the adjacent restraint portion (melting portion) 53 close to a fixed end portion 50*a* of the rim 50, the slope of the temperature characteristics of the rate becomes much smaller (refer to C2 in FIG. 7). In this manner, the restraint portion (melting portion) is continuously added so that the temperature characteristics of the rate eventually becomes flat as illustrated by C3 in FIG. 7.

As described above, if the restraint portion (melting portion) 53 to be added is positioned close to the fixed end portion 50*a* of the rim 50, the movement amount of the free end portion 50*b* is largely increased, and if positioned close to the free end portion 50*b* of the rim 50, the movement amount of the free end portion 50*b* is decreased. Accordingly, it is possible to minutely and fully adjust the temperature correction amount of the moment of inertia, and thus it is possible to set an optimal rate within an operating range of the timepiece.

In the above description, a case has been described where, among three arcuate and belt-shaped pieces into which the rim 50 is divided along the circumferential direction (first arcuate section 40*a*, second arcuate section 40*b* and third arcuate section 40*c*), all the pieces have the restraint portions (melting portions) 53 which are formed with the separated interval a. However, the separated interval a of the restraint portions (melting portions) 53 may be differently formed for each of the belt-shaped pieces. In this case, as illustrated in FIG. 2, the first arcuate section 40*a* has the restraint portions (melting portions) 53 formed with the separated interval a, the second arcuate section 40*b* has the restraint portions (melting portions) 53 formed with a separated interval b, and further the third arcuate section 40*c* has the restraint portions (melting portions) 53 formed with a separated interval c as described above. It is possible to suppress the variations in the belt-shaped pieces in the deformation volume of the free end by individually adjusting the respective intervals a, b and c. Therefore, it is possible to prevent the rotational balance from being degraded due to the variations in the deformation volume.

In the above description, a case has been described where the rim 50 is divided into three along the circumferential direction, but the divided number may be a natural number of two or more. That is, if the divided number enables the free end of the respective arcuate sections to be deformed due to the temperature change, any number may be acceptable. In this case, it is preferable that the respective arcuate sections be equally arranged in rotational symmetry around the axle O.

In particular, unlike in a case of using the balance screw in the related art, it is possible to precisely perform the temperature correction through easy work of simply adding the restraint portion (melting portion) 53 of the rim 50, thereby facilitating adjustment work.

In addition, even if the restraint portion (melting portion) 53 is added to adjust the temperature correction amount of the moment of inertia, the moment of inertia itself is not changed and the center of gravity of the balance 40 also is not changed. Thus, the rotational balance is also unlikely to be degraded. Therefore, unlike in the case of using the balance screw in the related art, it is not necessary to readjust the rate or the rotational balance.

In addition, according to the movement 10 of the present embodiment, there is provided the balance 40 in which the temperature dependence of the oscillation cycle is lessened and the rate influenced by the temperature change is unlikely to vary. Thus, it is possible to provide the high quality movement having few errors.

In addition, according to the mechanical timepiece 1 of the present embodiment, there is provided the movement 10 in which the rate influenced by the temperature change is unlikely to vary. Thus, it is possible to provide the high quality timepiece having few errors.

In addition, in a method of the related art, even by using the bimetal, it is necessary to minutely adjust the deformation volume with respect to the temperature or to minutely adjust the overall balance. In practice, it is necessary to carry out the work for attaching a plurality of balance screws to the rim portion and adjusting an attachment position of the balance screws or screwing intensity. For example, even if the temperature rises, if the timepiece is slow, the process of correcting the moment of inertia is performed by carrying out the work such as changing work to transfer the balance screws to the free end side.

As described above, since the fine adjustment work using the balance screws is required in practice, the temperature correction needs labor and time, thereby resulting in poor workability. Moreover, if the screwing intensity of each balance screw is changed in a case of readjusting, the overall moment of inertia is changed to cause the oscillation cycle of the balance, that is, the rate of the timepiece, to be changed. Accordingly, it is necessary to readjust the rate, thereby resulting in the cumbersome work.

In addition, in some cases, the balance screw is not arranged in good balance in the circumferential direction, thereby causing the rotational balance of the balance to be degraded.

The balance according to the present invention includes the balance staff which is pivotally supported rotatably and the balance wheel which is arranged around the balance staff and in which one end portion is the fixed end portion fixed to the connection arm, which is radially connected to the balance staff, and the other end portion is the free end portion, which can be radially deformed. The balance wheel has the first rim, which is fixed to the connection arm, and the second rim, which is arranged to be overlapped with the first rim and formed of the material having the linear expansion coefficient different from the first rim. The first rim and the second rim are restrained relative to each other by using the plurality of restraint portions (melting portions), which are separated from each other.

According to the balance of the present invention, if the temperature is changed, there is the difference in the thermal expansion coefficient between the first rim and the second rim. The first rim and the second rim are mutually restrained from moving relative to each other by using the plurality of restraint portions (melting portions), thereby enabling the free end portion of the balance wheel to move radially inward or outward. Accordingly, it is possible to change the distance from the free end portion of the balance wheel to the axle, and thus it is possible to change the moment of inertia of the balance itself. Therefore, it is possible to change the slope of the temperature characteristics in the moment of inertia, and it is possible to lessen the temperature dependence of the oscillation cycle of the balance. Consequently, it is possible to provide the high quality balance in which the rate influenced by the temperature change is unlikely to vary.

In the balance according to the present invention, each of the separated intervals between the restraint portions (melting portions) is formed so as to be the predetermined interval, and the predetermined interval allows the movement amount of the free end portion to be set.

In this case, the movement amount of the free end portion of the balance wheel is set by forming the separated interval so as to have the slope of the temperature characteristics of the necessary moment of inertia in advance. Accordingly, it is possible to easily set the temperature correction amount. It is possible to change the movement amount of the free end portion with respect to the temperature by adjusting the separated interval. Accordingly, it is possible to minutely adjust the temperature correction amount so as to match the variations in the temperature characteristics of the hair spring or the variations in the deformation volume of the free end portion of the balance wheel, and thus it is easy to efficiently and precisely carry out the temperature correction work. In addition, even if the sizes of the intervals are different from each other due to the adjustment of the separated interval, the rotational balance is no longer degraded, thereby easily ensuring the excellent rotational performance. Furthermore, even if the separated interval is adjusted, the moment of inertia itself of the balance is unlikely to vary. Therefore, it does not necessarily require the readjustment of the rate.

In the balance according to the present invention, there is further provided the hair spring which stores the rotational power of the balance wheel, and the predetermined interval is set according to the rate of change in the spring constant of the hair spring, which is caused by the temperature change.

In this case, it is possible to set the movement amount of the free end portion of the balance so as to match the slope of the temperature characteristics of the spring constant of the hair spring to be combined therewith, thereby enabling the temperature correction to be more accurately performed.

In the balance according to the present invention, the balance wheel has the first arcuate section and the second arcuate section which are divided in the circumferential direction around the balance staff. The separated interval of the plurality of restraint portions (melting portions) in the first arcuate section is different from the separated interval of the plurality of restraint portions (melting portions) in the second arcuate section.

According to the balance of the present invention, it is possible to individually adjust the intervals between the restraint portions (melting portions) in each of the arcuate sections divided in the circumferential direction. Accordingly, it is possible to suppress the variations between the arcuate sections in the deformation volume of the free end portion, and thus it is possible to prevent the rotational balance from being degraded due to the variations in the deformation volume.

The timepiece movement according to the present invention includes the barrel wheel which has the power source; the train wheel which transmits the rotational force of the barrel wheel; and the escapement mechanism which controls the rotation of the train wheel. The escapement mechanism includes the balance according to the present invention.

According to the timepiece movement of the present invention, there is provided the balance in which the temperature dependence of the oscillation cycle is lessened as described above and the rate influenced by the temperature change is unlikely to vary. Therefore, it is possible to provide the high quality timepiece movement having few errors.

The timepiece according to the present invention includes the timepiece movement according to the present invention.

According to the timepiece of the present invention, there is provided the timepiece movement in which the rate influenced by the temperature is unlikely to vary. Therefore, it is possible to provide the high quality timepiece having few errors.

In the manufacturing method of the balance according to the present invention, the balance wheel is formed in such a manner that one end portion is arranged to be the fixed end portion fixed to the connection arm which is radially connected to the balance staff and the other end portion is arranged to be the free end portion which can be radially deformed. The deformation volume of the free end portion is adjusted by relatively restraining the first rim fixed to the connection arm and the second rim arranged to be overlapped with the outer periphery of the first rim and formed of the material having the linear expansion coefficient different from the first rim using the plurality of restraint portions (melting portions) which are separated from each other, and by adjusting each of the separated intervals between the restraint portions (melting portions).

According to the manufacturing method of the balance of the present invention, it is possible to change the movement amount of the free end portion with respect to the temperature by adjusting the separated interval. Thus, it is possible to minutely adjust the temperature correction amount to match the variations in the temperature characteristics of the hair spring or the variations in the deformation volume of the free end portion of the balance wheel, and thus it is easy to efficiently and precisely carry out the temperature correction work. In addition, even if the sizes of the interval are different from each other due to the adjustment of the separated interval, the rotational balance is no longer degraded, thereby easily ensuring the excellent rotational performance. Furthermore, even if the separated interval is adjusted, the moment of inertia itself of the balance is unlikely to vary. Therefore, it does not necessarily require the readjustment of the rate.

What is claimed is:

1. A balance comprising:

a balance staff pivotally supported rotatably; and a balance wheel arranged around the balance staff and in which one end portion is a fixed end portion fixed to a connection arm which is radially connected to the balance staff and the other end portion is a free end portion which can be radially deformed;

wherein the balance wheel has a first rim which is connected to the connection arm and a second rim which is arranged to be overlapped with the first rim and formed of a material having a linear expansion coefficient different from the first rim;

wherein the first rim and the second rim are arranged in a circumferential direction and are bonded together by a plurality of melting portions formed of melted materials of the first and second rims, the plurality of melting portions being formed on upper and lower surfaces of and in an intermediate position between the first and second rims.

2. The balance according to claim claim 1, wherein the balance wheel has a first arcuate section and a second arcuate section which are circumferentially divided around the balance staff; and wherein an interval spaced between the plurality of melting portions in the first arcuate section is different from an interval spaced between the plurality of melting portions in the second arcuate section.

3. The balance according to claim 1, wherein one of the melting portions is continuously formed in a circumferential direction on a bonding surface between the first rim and the second rim.

4. The balance according to claim 1, wherein the second rim is arranged to be overlapped with an outer periphery of the first rim, and wherein the plurality of melting portions are formed apart from each other on a bonding surface between the first rim and the second rim.

5. A timepiece movement comprising:

a barrel wheel having a power source;

a train wheel which transmits a rotational force of the barrel wheel; and an escapement mechanism which controls rotation of the train wheel;

wherein the escapement mechanism includes the balance according to claim 1.

6. A timepiece comprising: the timepiece movement according to claim 5.

7. The balance according to claim 1, wherein the balance wheel comprises a rim divided along a circumferential direction thereof into a plurality of belt-shaped pieces each formed of the first and second rims bonded together by the plurality of melting portions.

8. A balance comprising:

a balance staff pivotally supported rotatably; and a balance wheel arranged around the balance staff and in which one end portion is a fixed end portion fixed to a connection arm which is radially connected to the balance staff and the other end portion is a free end portion which can be radially deformed;

wherein the balance wheel has a first rim connected to the connection arm and a second rim arranged to be overlapped with the first rim and formed of a material having a linear expansion coefficient different from the first rim;

wherein the first rim and the second rim are bonded together by a plurality of melting portions in which respective materials thereof are melted;

wherein the balance wheel has a first arcuate section and a second arcuate section which are circumferentially divided around the balance staff; and wherein an interval spaced between the plurality of melting portions in the first arcuate section is different from an interval spaced between the plurality of melting portions in the second arcuate section.

9. A balance comprising:

a balance staff pivotally supported rotatably; and a balance wheel comprised of a plurality of arcuate sections each connected by a connection arm to the balance staff, each of the arcuate sections having first and second rims bonded together by a plurality of melting portions formed of melted materials of the first and second rims.

10. The balance according to claim 9, wherein each of the arcuate sections has a fixed end portion connected to the connection arm and a free end portion configured to be radially deformed.

11. The balance according to claim 9, wherein the material of the second rim has a linear expansion coefficient different from the material of the first rim.

12. The balance according to claim 9, wherein the plurality of melting portions are formed on upper and lower surfaces of and in an intermediate position between the first and second rims.

13. The balance according to claim 9, wherein second rim is arranged to be overlapped with an outer periphery of the first rim; and wherein the plurality of melting portions are formed apart from each other on a bonding surface between the first and second rims.

14. The balance according to claim 9, wherein for each of the arcuate sections, the plurality of melting portions are spaced at an interval along circumferential directions of the first and second rims.

15. The balance according to claim 14, wherein the spacing interval for the plurality of melting portions of one of the arcuate sections is different from the spacing interval of the plurality of melting portions for each of the other of the arcuate sections.

16. The balance according to claim 9, wherein for each of the arcuate sections, one of the melting portions is continuously formed in a circumferential direction on a bonding surface between the first and second rims.

17. A timepiece movement comprising:

a barrel wheel having a power source;

a train wheel for transmitting a rotational force of the barrel wheel; and an escapement mechanism having the balance according to claim 9 for controlling rotation of the train wheel.

18. A timepiece comprising the timepiece movement according to claim 17.

* * * * *